US008282331B2

(12) United States Patent
Burns et al.

(10) Patent No.: US 8,282,331 B2
(45) Date of Patent: Oct. 9, 2012

(54) METHOD OF REMEDIATING A CONTAMINATED WASTE SITE

(75) Inventors: Steven Lee Burns, St. Louis, MO (US); Derek D. Ingram, Festus, MO (US); John D. Linnemann, Millstadt, IL (US); Stanley E. Deeke, Fairview Heights, IL (US); Jeffrey K. Tardrew, Vero Beach, FL (US)

(73) Assignee: Ameren Corporation, St. Louis, MO (US)

( * ) Notice: Subject to any disclaimer, the term of this patent is extended or adjusted under 35 U.S.C. 154(b) by 428 days.

(21) Appl. No.: 12/568,329

(22) Filed: Sep. 28, 2009

(65) Prior Publication Data

US 2011/0076102 A1 Mar. 31, 2011

(51) Int. Cl.
*E04G 21/14* (2006.01)

(52) U.S. Cl. ..... 414/12; 414/435; 52/143; 405/128.1

(58) Field of Classification Search ..... 405/128.1, 405/303; 52/741.1, 741.11, 741.12, 741.13, 52/741.14, 741.15, 143, 745.2; 29/897, 428
See application file for complete search history.

(56) References Cited

U.S. PATENT DOCUMENTS

| | | | | |
|---|---|---|---|---|
| 2,357,633 | A | 9/1944 | Cowgill, Jr. | |
| 2,575,572 | A | 11/1951 | Wickstrum | |
| 3,599,808 | A | 8/1971 | Bisson | |
| 3,653,527 | A | 4/1972 | Seymour | |
| 3,767,071 | A | 10/1973 | Harbers | |
| 3,887,204 | A | 6/1975 | Austin | |
| 3,990,532 | A | 11/1976 | Robinson | |
| 4,044,854 | A | 8/1977 | Schmitt | |
| 4,065,892 | A | 1/1978 | Lawrence | |
| 4,123,038 | A | 10/1978 | Meyers | |
| 4,128,973 | A | 12/1978 | Robinson | |
| 5,035,537 | A | 7/1991 | Rose | |
| 5,201,152 | A * | 4/1993 | Heffner | 52/64 |
| 5,356,452 | A | 10/1994 | Fahey | |
| 5,361,550 | A | 11/1994 | Kaden | |
| 5,387,074 | A | 2/1995 | Brown | |
| 5,417,539 | A | 5/1995 | van der Wal | |
| 5,461,832 | A | 10/1995 | Smith | |
| 5,511,908 | A | 4/1996 | Van Valkenburgh | |
| 5,622,864 | A | 4/1997 | Buchanan | |
| 5,639,936 | A | 6/1997 | Corte | |
| 5,655,734 | A | 8/1997 | Dahl | |
| 5,700,109 | A | 12/1997 | Hund | |
| 5,716,186 | A | 2/1998 | Jensen | |
| 5,863,510 | A | 1/1999 | Pozniak | |
| 5,868,940 | A | 2/1999 | Gurfinkel | |
| 6,027,295 | A | 2/2000 | Geppert | |
| 6,668,496 | B1 | 12/2003 | Clapp | |
| 6,763,633 | B2 | 7/2004 | Cote | |
| 6,846,144 | B2 | 1/2005 | Justice | |
| 7,021,014 | B1 | 4/2006 | Wolfe | |

(Continued)

OTHER PUBLICATIONS

From www.fabricstructures-USA.com regarding segment titled "wheel mounted & crane liftable"; 2007; 6 pages.

*Primary Examiner* — John Kreck
*Assistant Examiner* — Sean Andrish
(74) *Attorney, Agent, or Firm* — Senniger Powers LLP

(57) ABSTRACT

A method and system for moving a large temporary building from a first location to a second location, while the building remains erect, are disclosed. The invention is particularly suited for moving such a building during the remediation of a contaminated waste site.

4 Claims, 14 Drawing Sheets

U.S. PATENT DOCUMENTS

| | | | |
|---|---|---|---|
| 7,159,888 | B1 | 1/2007 | Sutton |
| 7,165,370 | B1 | 1/2007 | Wolfe |
| 7,452,173 | B2 | 11/2008 | Rhodes |
| 2004/0052616 | A1 | 3/2004 | Stanley |
| 2004/0160084 | A1 | 8/2004 | Mason |
| 2005/0212243 | A1 | 9/2005 | Terry |
| 2005/0223665 | A1 | 10/2005 | Maas |
| 2007/0113488 | A1 | 5/2007 | Wilson |
| 2007/0137115 | A1 | 6/2007 | Towell |
| 2007/0266650 | A1 | 11/2007 | Cohen |
| 2008/0111327 | A1 | 5/2008 | Rhodes |
| 2008/0164078 | A1 | 7/2008 | Rhodes |
| 2008/0184658 | A1 | 8/2008 | Rhodes |
| 2009/0067952 | A1 | 3/2009 | Rhodes |

* cited by examiner

METHOD OF REMEDIATING A CONTAMINATED WASTE SITE

FIELD OF THE INVENTION

The present invention generally relates to systems and methods for moving large temporary buildings, including fabric structure buildings which can be used to remediate waste sites.

BACKGROUND OF THE INVENTION

The remediation of contaminated waste sites (e.g., manufactured gas plant (MPG) remediation) involves such conventional techniques as excavation and off-site disposal of wastes, chemical fixation, soil washing, in-situ thermal treatment, incineration of excavated soil and other technologies. In some instances, a large temporary building, resembling a large tent, is erected over a first area of the site, and clean-up activities are carried out inside the tent to contain fugitive air emissions. The size of the tent-like building can vary, e.g., from 20-40 meters or more wide and 20-60 meters or more long. After clean-up of the first area is finished, the tent is disassembled, moved to a second area of the site, and re-assembled so that clean-up can continue. This procedure is repeated until all areas of the site have been remediated. The process of disassembling the temporary building, moving it from one site area to another, and then re-assembling the building, is time-consuming, typically taking six or seven weeks. As a result, completion of the clean-up is delayed. Moreover, resources on the site, such as remediation equipment and personnel, consulting personnel, and air monitoring equipment and personnel, remain largely idle during the delay, which unavoidably increases overhead costs.

There is a need, therefore, for a more efficient way to move large temporary buildings.

SUMMARY OF THE INVENTION

This invention is directed to, among other things, a method of moving a large temporary building from a first location to a second location. The building has a first side and a second side opposite the first side, a frame, and a cover supported by the frame. The method comprises the steps of connecting a plurality of leading dollies to the frame of the building at the first side of the building, each dolly comprising a platform with caster wheels and a lifting device on the platform. Another step of the method involves connecting a plurality of trailing dollies to the frame of the building at the second side of the building, each trailing dolly comprising a platform with caster wheels and a lifting device on the platform. At least two of the leading dollies are connected by a substantially rigid connector. The method also involves operating the lifting devices on the leading and trailing dollies to lift the building for transport, and applying a force to roll the dollies and the lifted building from the first location to the second location. The lifting devices on the leading and trailing dollies are operated to lower the building at the second location.

This invention is also directed to a transport system for moving a large temporary building of the type described in the previous paragraph from a first location to a second location. The transport system comprises a plurality of first dollies, each first dolly comprising a platform with caster wheels and a lifting device on the platform for lifting the first side of the building prior to moving the building. A substantially rigid connector is provided for rigidly connecting two of the first dollies. The system also includes a plurality of second dollies, each second dolly comprising a platform with caster wheels and a lifting device on the platform for lifting the second side of the building prior to moving the building. Each of the lifting devices comprises a lifting structure and a lifting mechanism on the platform for raising and lowering the lifting structure relative to the platform. A least one fastening device is provided for fastening each lifting structure of the first and second dollies to the frame of the building at a respective side of the building whereby the building may be lifted, rolled on the dollies from the first location to the second location, and lowered.

This invention is also directed to a method of remediating a contaminated waste site. The method involves installing a temporary building at a first location on the site, the temporary building comprising a frame and a cover, and remediating the site inside the temporary building at the first location. The method further comprises lifting the temporary building while it remains erect, moving the temporary building while it remains erect to a second location on the site, lowering the temporary building while it remains erect to place it on the site, and remediating the site inside the temporary building at the second location. The lifting, moving and lowering of the temporary building is accomplished by connecting a plurality of leading dollies to a first side of the temporary building and a plurality of trailing dollies to a second side of the temporary building, operating the dollies to lift respective first and second sides of the temporary building, applying a motive force to the leading dollies to roll the dollies and the temporary building from the first location to the second location, and operating the dollies to lower respective first and second sides of the temporary building.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
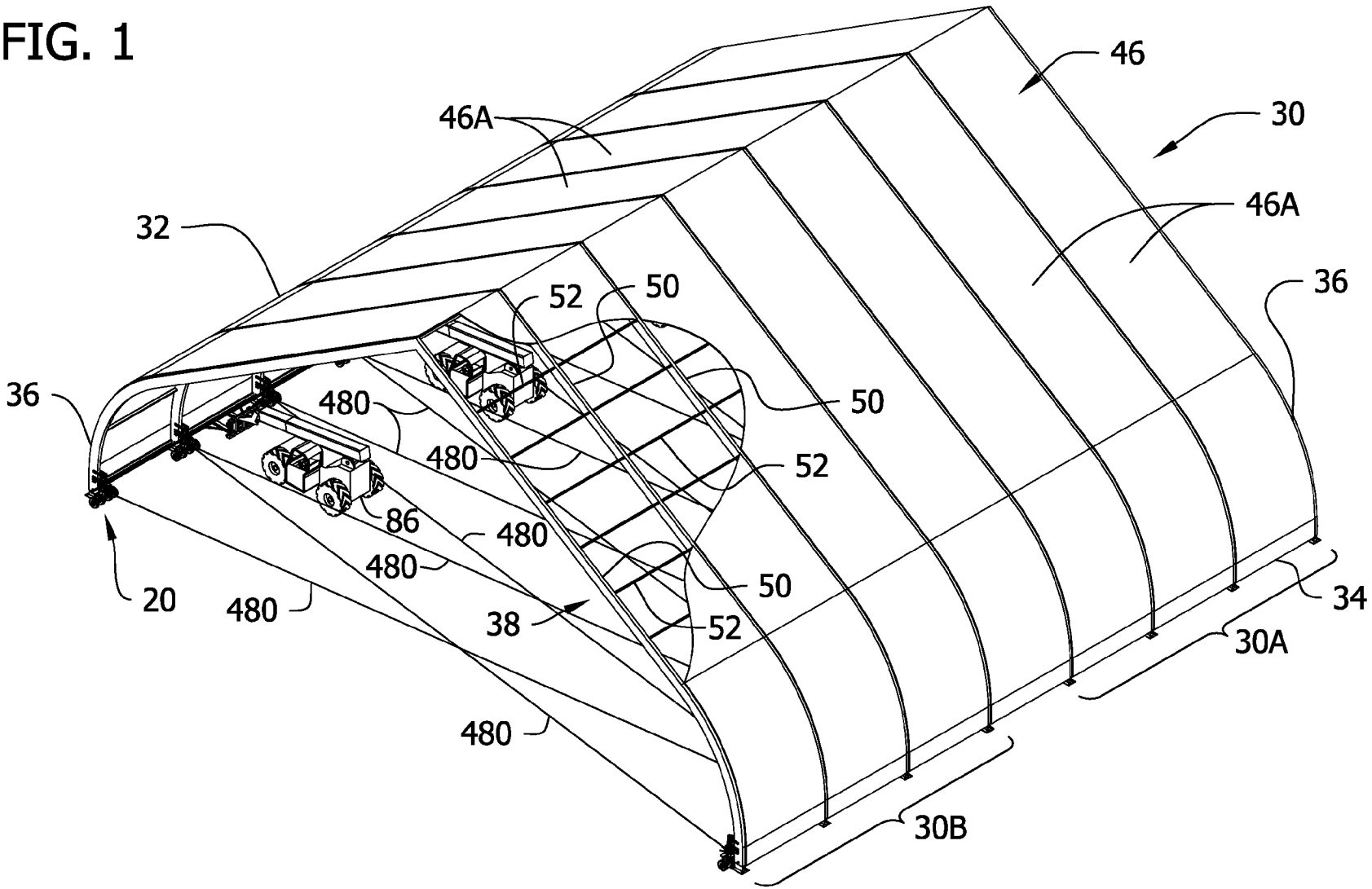
FIG. 1 is a perspective of a large temporary building and a transport system of this invention used to move the building.
Figure 2:
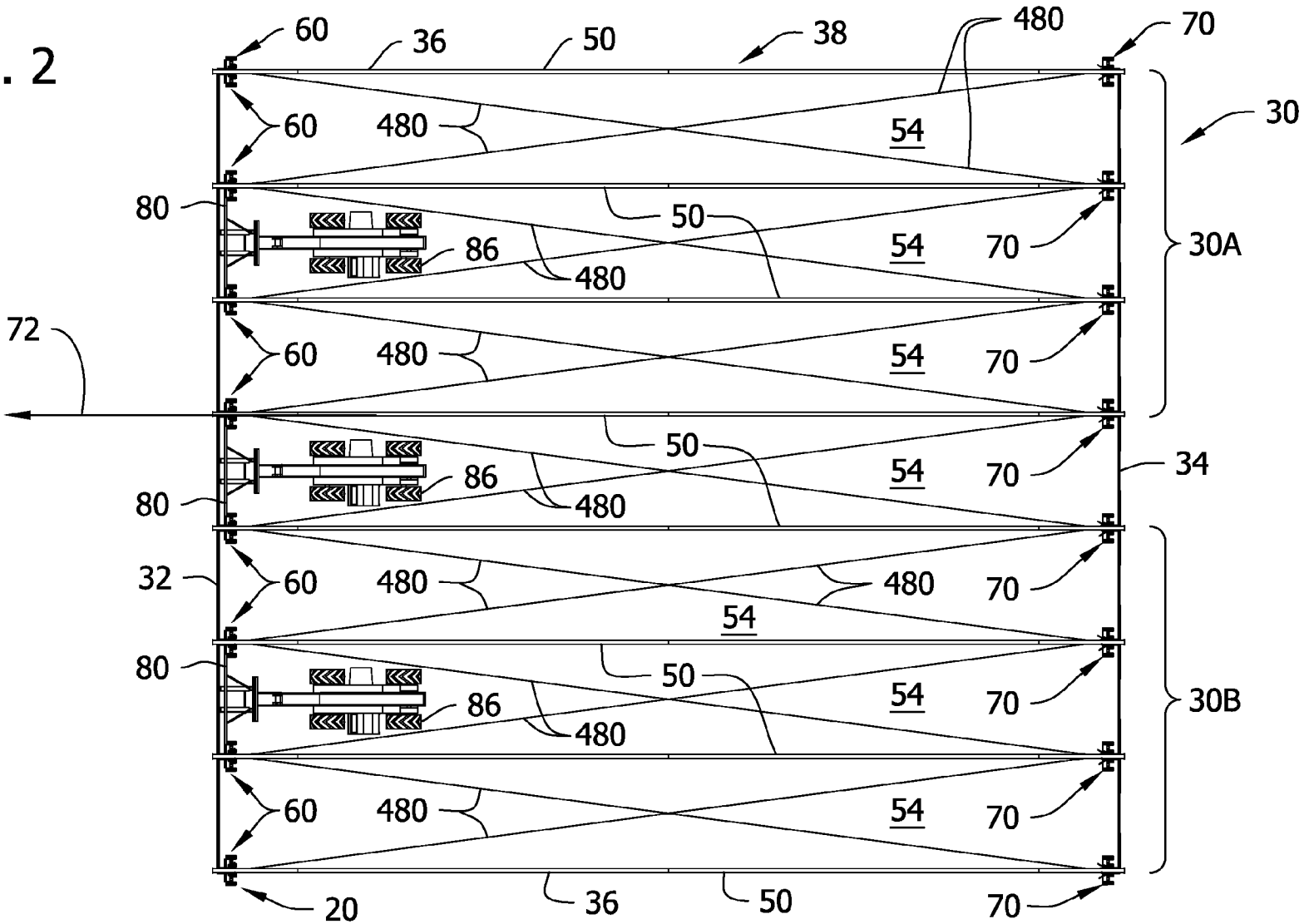
FIG. 2 is a schematic plan view of the building and transport system of FIG. 1, certain frame components and the overlying cover forming the roof of the building being removed to show details.

Referring to FIGS. 1 and 2, a transport system of this invention, generally designated 20, is used for moving a large temporary building from a first location to a second location. An example of one such building 30 is shown in FIG. 1. The building 30 is a large tent-like structure having a first side 32, a second side 34 opposite the first side, opposite ends 36, a frame generally designated 38, and a cover 46 supported by the frame to form a roof for the building. In the illustrated embodiment, the frame 38 comprises a plurality of rigid ribs configured as arches 50 lying in generally parallel vertical planes spaced at intervals along the length of the building 30. Purlins 52 (not shown in FIG. 2) connect the arches. The arches 50 divide the structure into separate bays or sections 54, seven such bays being shown in FIG. 2. The lower ends of the arches 50 are connected to foot plates 56 (see FIG. 12) for supporting the arches upright. The connection between each foot plate 56 and a respective arch 50 may be a pivot connection for allowing the arch to pivot about a horizontal axis between a lowered (generally horizontal) position and an upright (generally vertical) position while the footplate remains flat on the ground. The foot plates 56 are anchored to the ground by suitable means, such as a series of long anchor bolts or pins (not shown) typically arranged in a pattern in which some of the anchor pins, referred to as the inside anchor pins, are located toward the inside of the structure and other anchor pins, referred to as outside anchor pins, are located toward the outside of the structure. The cover 46 comprises sheets of cover material (e.g., a flexible fabric such as vinyl-coated fabric) overlying the purlins 52. In one embodiment, the cover 46 comprises a number of separate sections 46A, e.g., one section for each bay 54, having releasable connections with respective arches 50 so that each cover section may be removed from the frame independent of the other cover sections.

In general, the structure 30 is erected by raising a first arch 50 of the frame 38 to an upright position, raising a second arch 50 of the frame to an upright position in which it is parallel to the first arch and spaced from the first arch by a distance corresponding to the width of one bay 54 of the building, and connecting the two upright arches by the purlins 52 and any other accompanying framework (e.g., criss-crossing cables). Additional arches 50 and purlins 52 are successively added to the structure until the frame 38 is complete. The cover sections 46 are then attached to the arches to complete the roof of the structure. Assembly of the structure also includes attaching gable ends (not shown) to the ends 36 of the structure and installing the necessary doors and other openings (e.g., vents and exhaust ports), not shown. The structure is disassembled by reversing these steps. The assembly and disassembly process is time-consuming and labor-intensive. By way of example, the process of moving the building from one location to another by disassembling the components, transporting the components, and then reassembling the components can take 6 to 7 weeks.

The transport system 20 is used to transport the temporary building 30 from one location to another while the building remains erect, that is, without first disassembling the entire building. As a result, substantial time and expense can be saved. In general, the transport system comprises a plurality of first dollies, each generally designated 60 in FIG. 2, for lifting the first side 32 of the building prior to moving the building, and a plurality of second dollies, each generally designated 70, for lifting the second side 34 of the building prior to moving the building. As shown in FIG. 2, the "first" dollies 60 are leading dollies with respect to a direction in which the building is to be moved (indicated by arrow 72), and the "second" dollies 70 are trailing dollies with respect to the direction in which the building is to be moved. The transport system 20 also includes one or more substantially rigid connectors 74, each of which is configured for connecting two adjacent leading dollies so that the dollies can be pushed by one or more motorized vehicles 86 to move the building, as will be described later.

Figure 3:
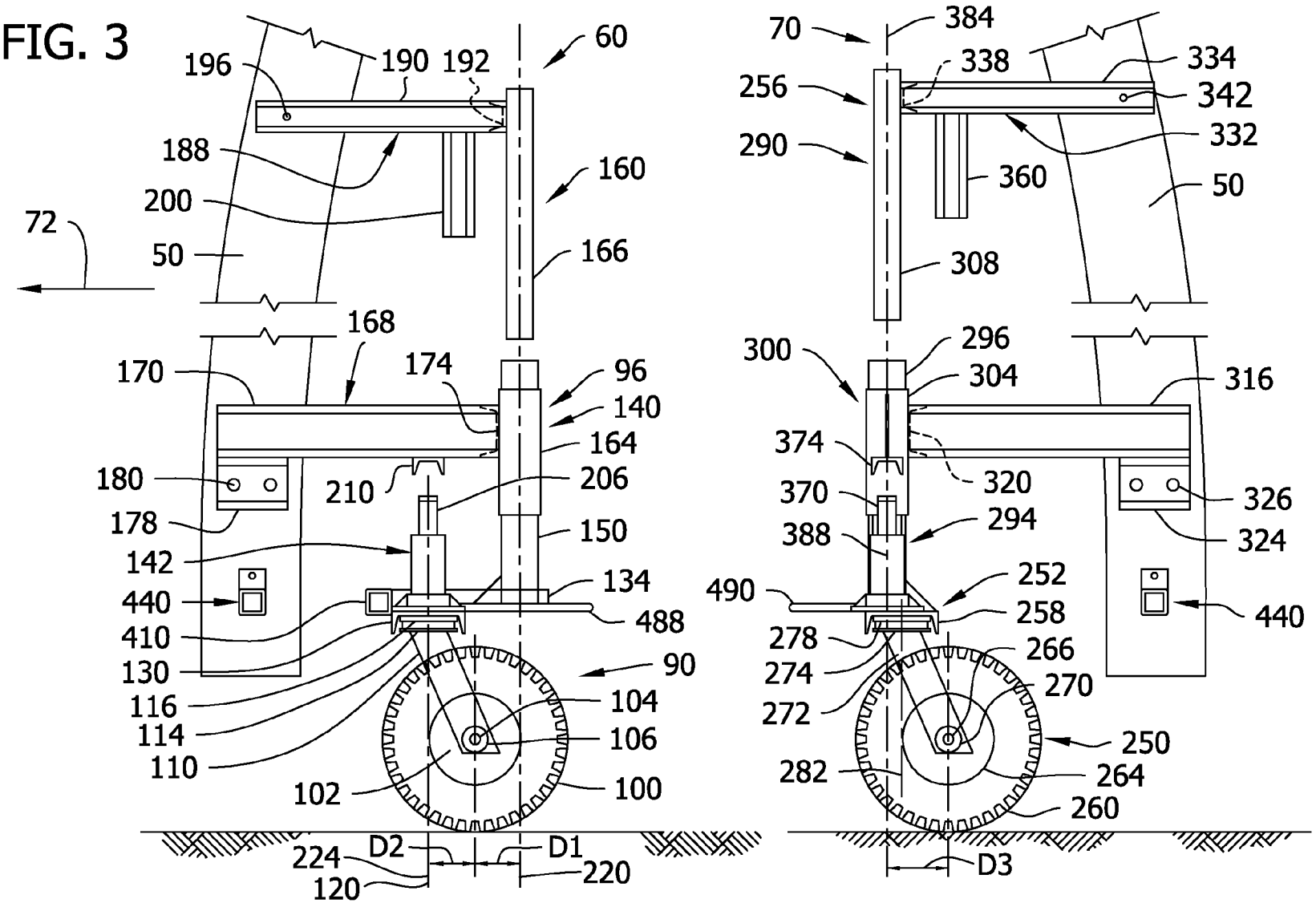
FIG. 3 is a side elevation showing leading and trailing dollies of the transport system lifting the building for transport.
Figure 4:
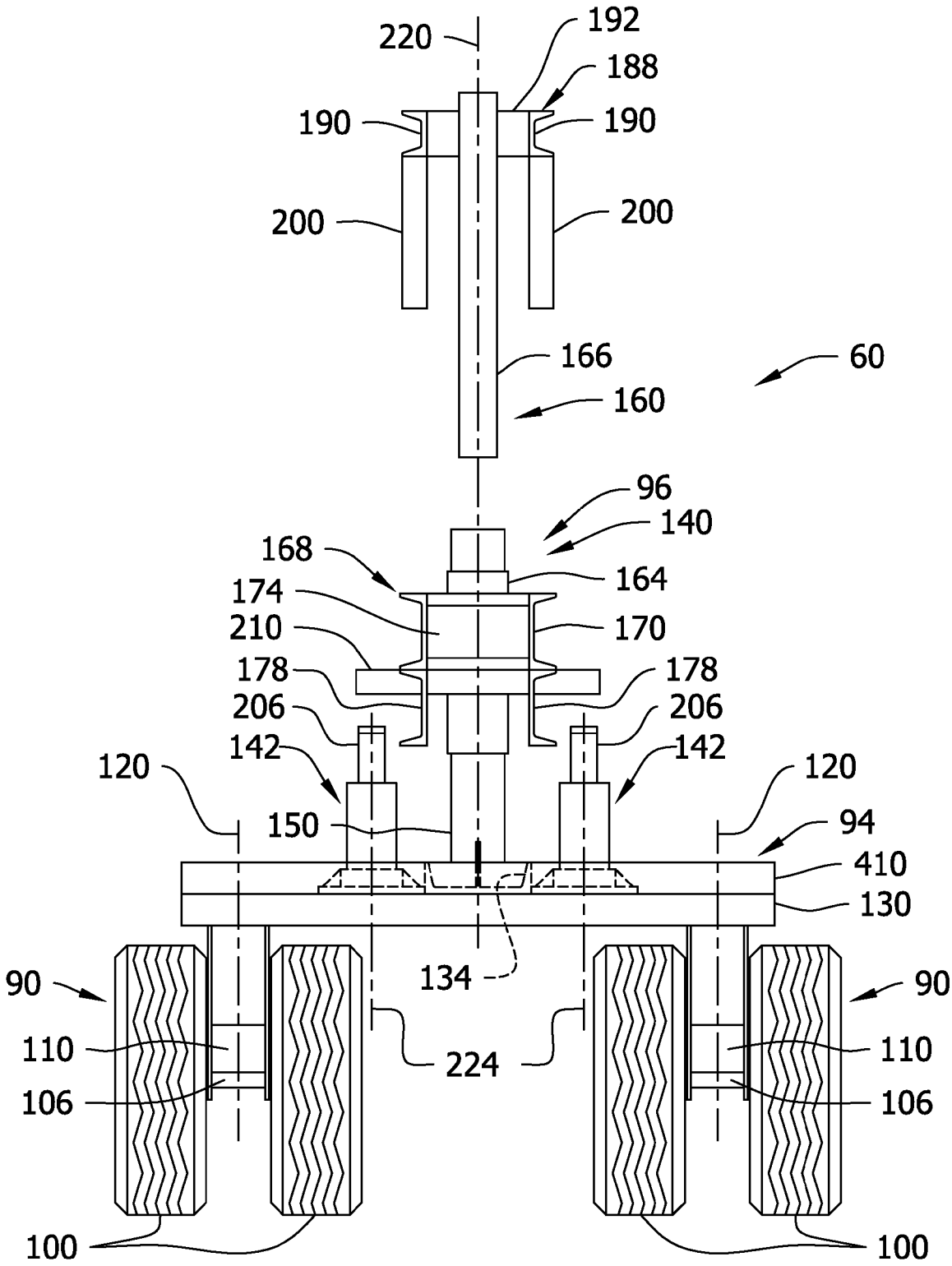
FIG. 4 is a front elevation of the leading dolly of FIG. 3, as viewed from the leading side of the dolly.
Figure 5:
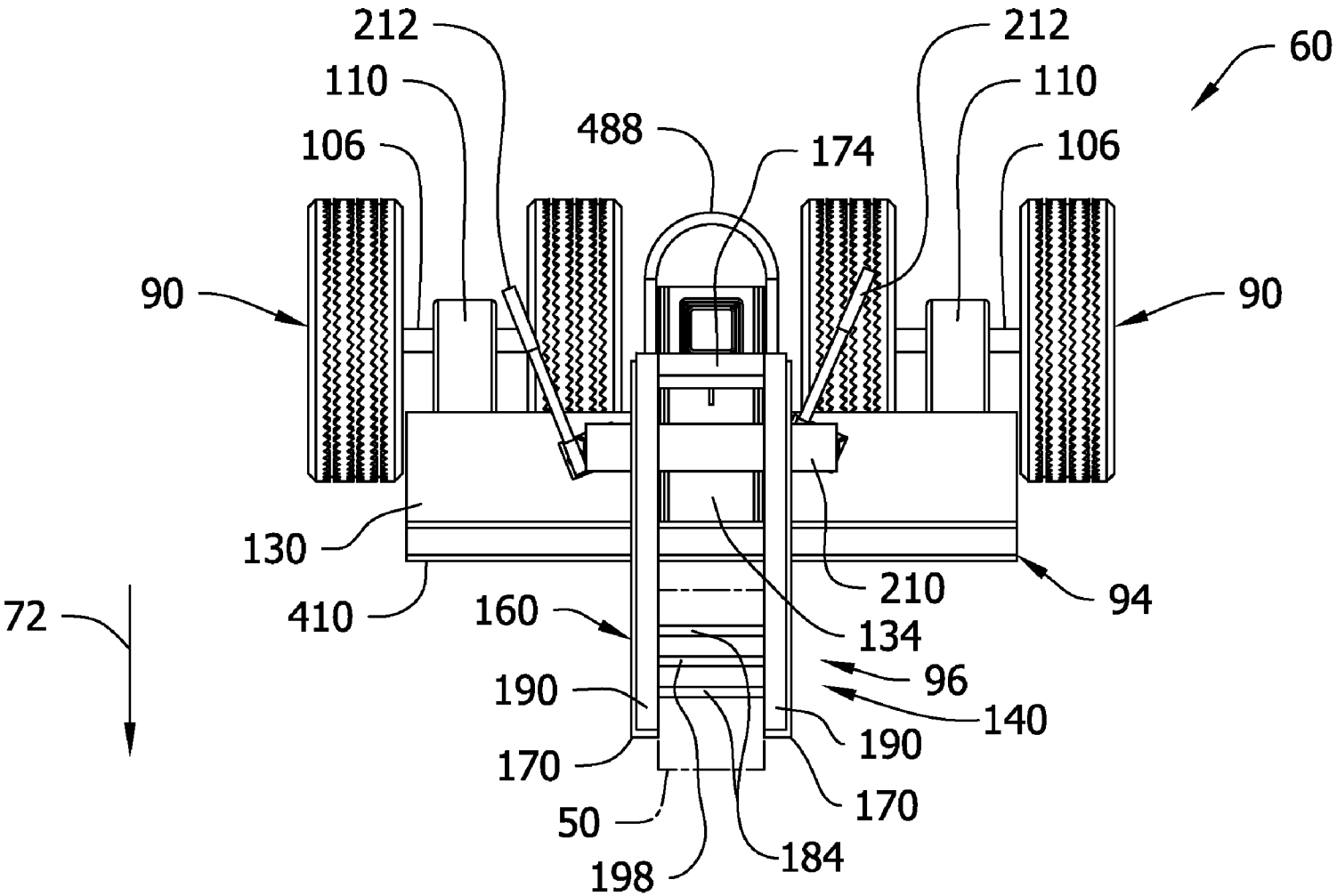
FIG. 5 is a top plan view of the leading dolly of FIG. 3.
Figure 6:
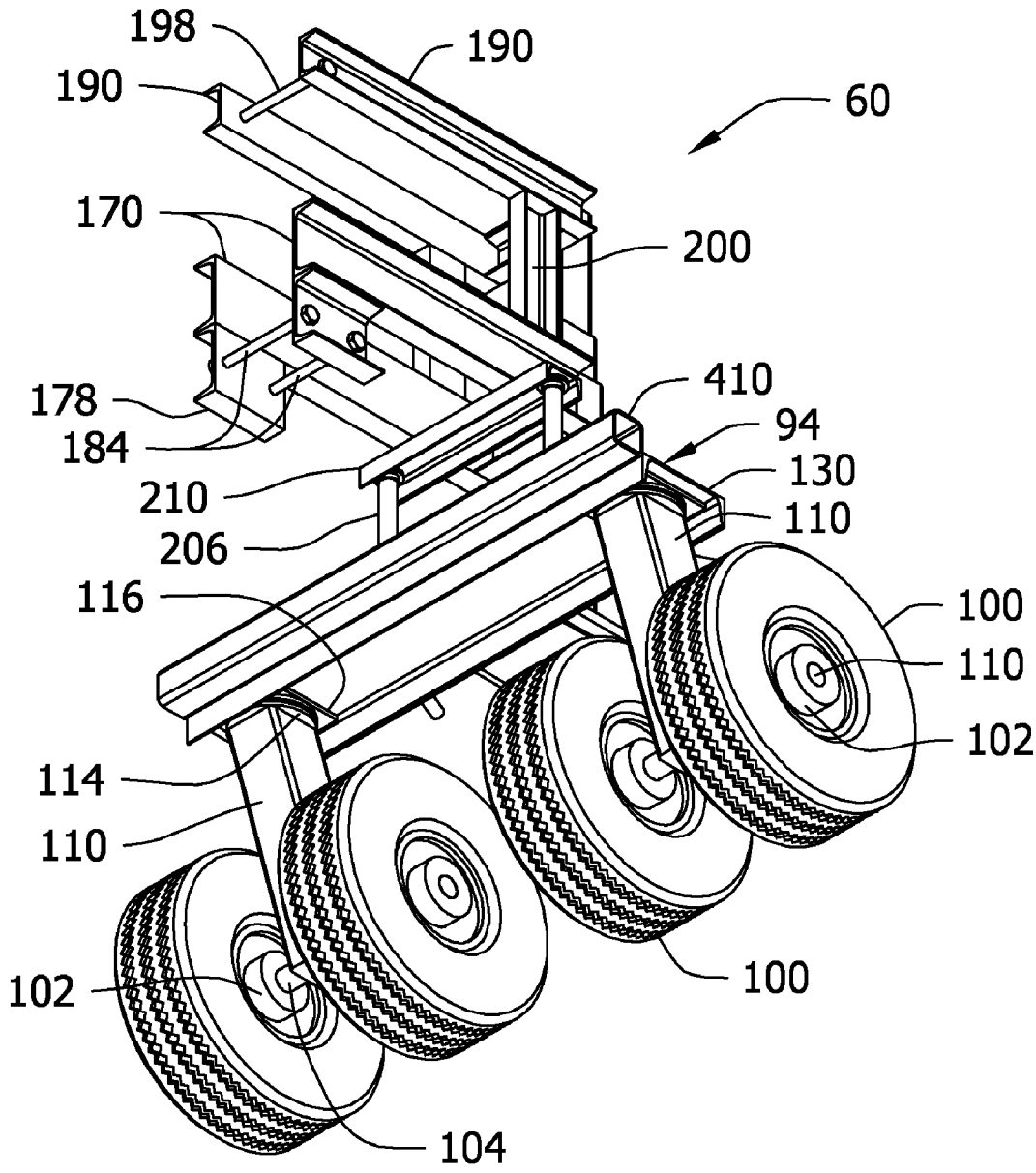
FIG. 6 is a bottom perspective of the leading dolly of FIG. 3.

Referring to FIGS. 3-6, each leading dolly 60 comprises two caster-wheel assemblies 90, a platform 94 supported by the two caster-wheel assemblies, and a lifting device 96 on the platform. Each caster-wheel assembly 90 includes a pair of caster wheels 100 having hubs 102 connected by an axle 104 rotatable in a sleeve 106 of an upstanding base 110 having a mounting plate 114 at its upper end. A swivel plate 116 is attached to the mounting plate 114 and is rotatable on bearings (not shown) about a generally vertical axis 120 (FIG. 4). By way of example but not limitation, the caster-wheel assembly 90 may be an assembly commercially available from AIE Company, Inc. of Norcross, Ga. under the designation 294BBl Series Cantilever Model. In this example, the caster wheels 100 have a 360-degree range of rotation, although it will be understood that the range may be less than 360 degrees. Other caster wheel assemblies may be used. Further, while the dolly 60 of the illustrated embodiment has four caster wheels 100, the number of wheels may vary.

The platform 94 comprises a metal structure including a cross beam 130 of inverted channel shape fastened to the swivel plates 116 of the two caster-wheel assemblies 90. The arrangement is such that the caster wheels 100 of the two assemblies are independently rotatable about their respective axes 120 relative to the platform 94 and to one another. The platform 94 also includes a cantilever beam 134 attached to the cross beam 130 and projecting from the trailing side of the platform. The caster-wheel assemblies 90 and platform 94 may have other configurations without departing from this invention.

Referring to FIGS. 3-6, the lifting device 96 on each leading dolly 60 comprises a lifting structure, generally designated 140, and a lifting mechanism 142 on the platform 94 for raising and lowering the lifting structure relative to the platform. The lifting structure 142 comprises a guide post 150 having a lower end attached to the cantilever beam 134 of the platform 94, and a lift frame 160 mounting for sliding movement up and down relative to the guide post. In the illustrated embodiment, the guide post 150 is a metal tube of rectangular (square) cross section. The lift frame 160 comprises a lower tube 164 of similar cross-sectional shape which can be moved on the outside of guide post 150 and an upper tube 166 also of similar cross-sectional shape which can move on the inside of the guide post. A lower cantilever structure 168 is secured (e.g., welded) to the lower tube 164 and includes two generally parallel lower arms 170 attached to a frame member 174 rigidly secured to the lower tube 164. The arms 170 extend generally horizontally and are spaced apart a distance generally corresponding to the width of an arch 50 of the frame 38. Mounting plates 178 at the ends of the arms 170 have holes 180 for receiving fasteners 184 (e.g., bolts) to releasably fasten the arms to opposite sides of the arch when the arch is received between the arms (see FIGS. 3, 6 and 12).

Similarly, an upper cantilever structure 188 is secured (e.g., welded) to the upper tube 166 and includes two generally parallel upper arms 190 attached to a frame member 192 rigidly secured to the upper tube 166. The upper arms 190 extend generally horizontally above the lower arms 170 and are spaced apart a distance generally corresponding to the width of an arch 50 of the frame 38. The ends of the upper arms 190 have holes 196 for receiving fasteners 198 (e.g., bolts) to releasably fasten the arms to opposite sides of the arch when the arch is received between the arms (see FIGS. 3, 6 and 12). The upper arms 190 are somewhat shorter than the lower arms to accommodate the curvature of the arch.

The upper cantilever structure 188, including the upper arms 190, is vertically movable independent of the lower cantilever structure 168 by sliding the upper tube 166 up and down in the guide post 150, so that the upper arms 190 can be fastened to the arch 50 at a suitable location above the lower arms 170. The upper cantilever structure 188 also includes two vertical spacer members 200 rigidly attached at their upper ends to the upper arms 190. The spacer members 200 have lower ends positioned for contact with respective lower arms 170 to maintain a minimum spacing between the upper and lower arms. The lifting structure 140 may have other configurations within this invention.

It will be observed that the lower and upper tubes 164, 166 and the lower and upper cantilever structures 168, 188 are removable from the guide post 150. This construction allows the dolly 60 to be more readily used in the field and more readily disassembled for convenient transport and storage.

The lifting mechanism 142 of each leading dolly comprises at least one and desirably two cylinder mechanisms, each of which is also designated 142. (The use of two cylinder mechanisms may help prevent binding of the telescoping parts during a lifting operation.) In the illustrated embodiment, the cylinder mechanisms 142 are mounted on the platform 94 on opposite sides of the guide post 150 as the dolly is viewed in FIG. 4. The cylinder mechanisms 142 have extensible and retractable plungers 206 which engage the lower cantilever structure 168 of the lift frame 160, and specifically with a cross beam 210 attached to the two lower arms 170 of the lower cantilever structure. When the plungers 206 of the cylinder mechanisms 142 are in engagement with the cross beam 210, operation of the mechanisms to extend the plungers will lift the lower arms 170 and the upper arms 190 a desired distance. (The upper arms 190 move simultaneously with the lower arms 170 due to the spacer members 200 on the upper arms contacting the lower arms.) In the illustrated embodiment, each cylinder mechanism 142 is a hydraulic bottle jack having a lever 212 (FIG. 5) for operating the jack. The jack has a stroke of seven in, for example, and is capable of lifting a six-ton load, but other types of jacks or lifting mechanisms having different load capacities and stroke lengths can be used.

Referring to FIG. 3, it will be observed that the central vertical axis 220 of the guide post 150 is on the trailing side of the axis of rotation of the wheels, the trailing offset being by a distance D1. On the other hand, the central vertical axes 224 of the jack plungers 206 are on the leading side of the axis of rotation of the wheels, the leading offset being by a distance D2. Desirably, from a load distribution standpoint, distances D1 and D2 are approximately equal. Other configurations may be used.

Figure 7:
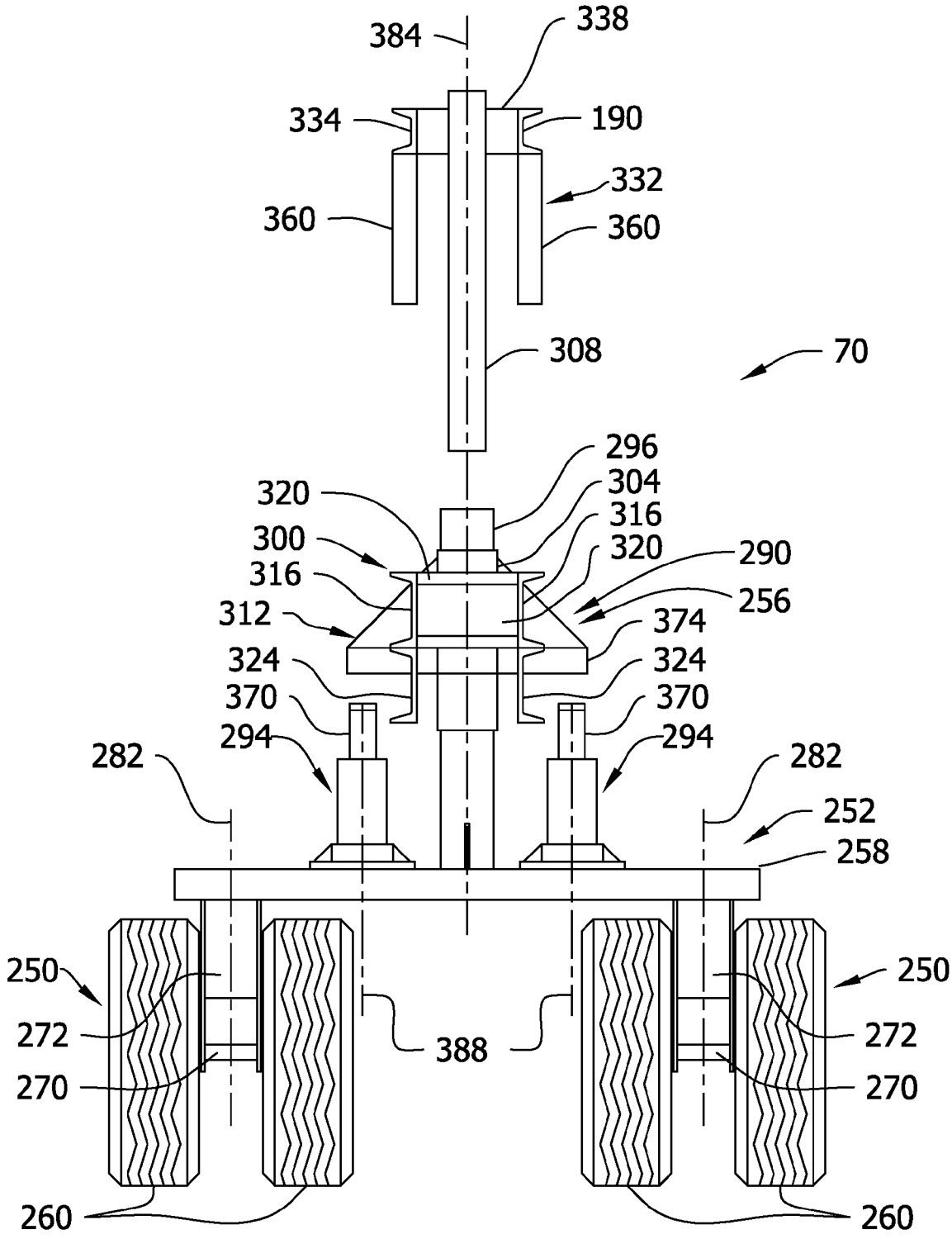
FIG. 7 is a rear elevation of the trailing dolly of FIG. 3, as viewed from the trailing side of the dolly.
Figure 8:
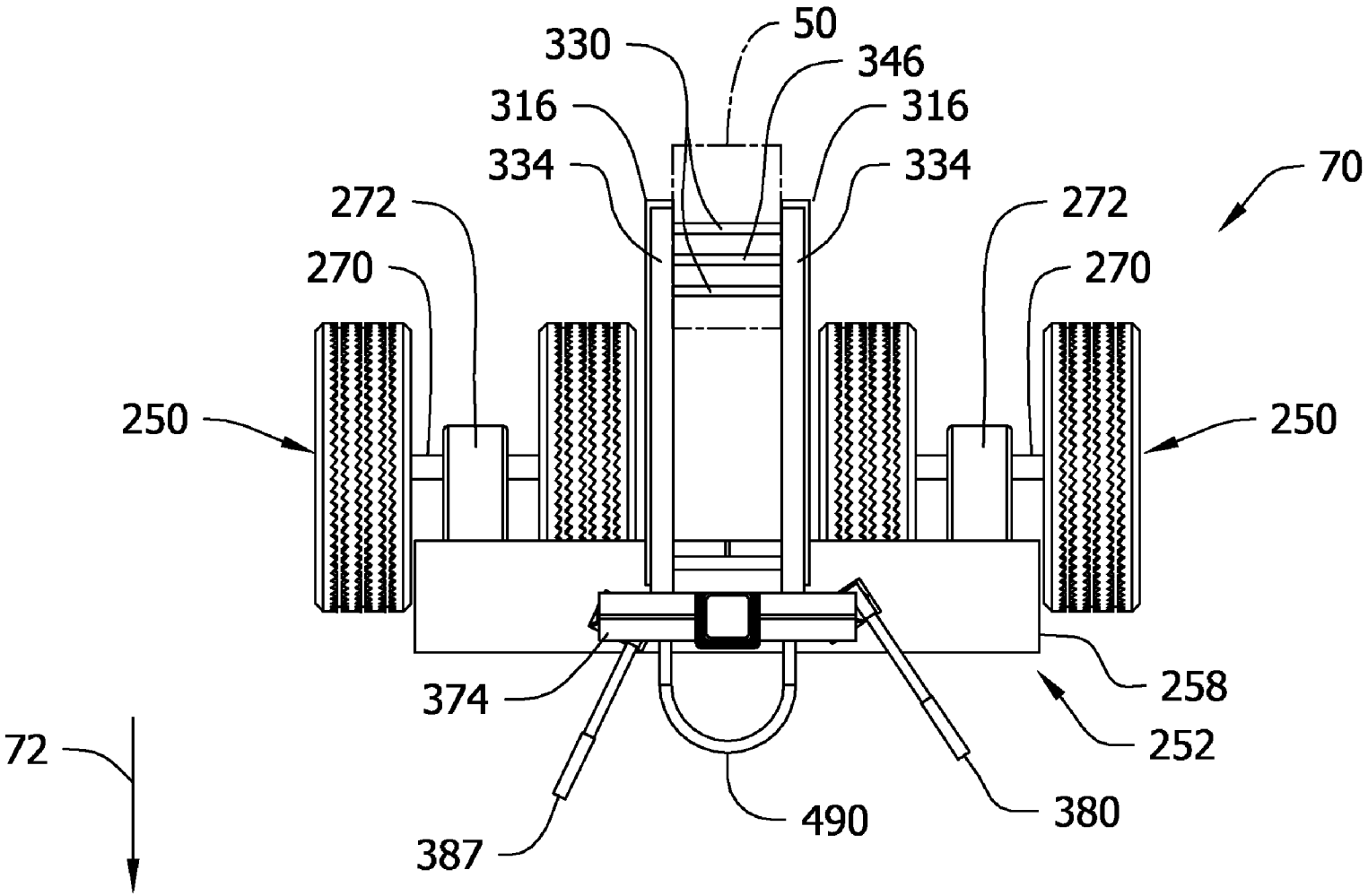
FIG. 8 is a top plan view of the trailing dolly of FIG. 3.

Referring to FIGS. 3, 7 and 8, the trailing dollies 70 have a construction similar to the leading dollies 60 described above. Each trailing dolly 70 comprises two caster-wheel assemblies 250, a platform 252 supported by the two caster-wheel assemblies, and a lifting device 256 on the platform. Each caster-wheel assembly 250 includes a pair of caster wheels 260 having hubs 264 connected by an axle 266 rotatable in a sleeve 270 of an upstanding base 272 having a mounting plate 274 at its upper end. A swivel plate 278 is attached to the mounting plate and is rotatable on bearings (not shown) about a generally vertical axis 282. By way of example but not limitation, the caster-wheel assembly 250 may be an assembly commercially available from AIE Company, Inc. of Norcross, Ga. under the designation 294BBl Series Cantilever Model. In this example, the caster wheels 100 have a 360-degree range of rotation, although it will be understood that the range may be less than 360 degrees. Other caster-wheel assemblies may be used. Further, while the dolly 70 of the illustrated embodiment has four caster wheels 100, the number of wheels may vary.

The platform 252 comprises a metal structure including a cross beam 258 of inverted channel shape fastened to the swivel plates 278 of the two caster-wheel assemblies 250. The arrangement is such that the caster wheels 260 of the two assemblies are independently rotatable about their respective axes 282 relative to the platform 252 and to one another. The caster-wheel assemblies 250 and platform 252 may have other configurations without departing from this invention.

The lifting device 256 on each trailing dolly 70 comprises a lifting structure, generally designated 290, and a lifting mechanism 294 on the platform 252 for raising and lowering the lifting structure relative to the platform. The lifting structure 290 comprises a guide post 296 having a lower end attached to the platform 252, and a lift frame 300 mounting for sliding movement up and down relative to the guide post. In the illustrated embodiment, the guide post 296 is a metal tube of rectangular (square) cross section. The lift frame 300 comprises a lower tube 304 of similar cross-sectional shape capable of sliding on the outside of guide post 296 and an upper tube 308 of similar cross-sectional shape movable on the inside of the guide post. A lower cantilever structure 312 is secured (e.g., welded) to the lower tube 304 and includes two parallel lower arms 316 attached to a frame member 320 rigidly affixed to the lower tube 304. The lower arms 316 extend generally horizontally and are spaced apart a distance generally corresponding to the width of an arch 50 of the frame 38. Mounting plates 324 at the ends of the arms 316 have holes 326 for receiving fasteners 330 (e.g., bolts in FIG. 8) to releasably fasten the arms to opposite sides of the arch when the arch is received between the arms (see FIGS. 3 and 8). Other fastening devices may be used.

Similarly, an upper cantilever structure 332 is secured (e.g., welded) to the upper tube 308 and includes two parallel upper arms 334 attached to a frame member 338 rigidly affixed to the upper tube 308. The upper arms 334 extend generally horizontally above the lower arms 316 and are spaced apart a distance generally corresponding to the width of an arch 50 of the frame 38. The ends of the arms 338 have holes 342 for receiving fasteners 346 (e.g., bolts in FIG. 8) to releasably fasten the arms to opposite sides of the arch when the arch is received between the arms. Other fastening devices may be used. The upper arms 334 are somewhat shorter than the lower arms 316 to accommodate the curvature of the arch.

The upper cantilever structure 332 of the trailing dolly 70, including the upper arms 334, is vertically movable relative to the lower cantilever structure 312 by sliding the upper tube 308 up and down inside the guide post 296, so that the upper arms 334 can be fastened to the arch 50 at a suitable location above the lower arms 316. The upper cantilever structure 330 also includes two vertical spacer members 360 rigidly attached at their upper ends to the upper arms. The spacer members 360 have lower ends positioned for contact with respective lower arms 316 to maintain a minimum spacing between the upper and lower arms. The lifting structure 290 may have other configurations within this invention.

It will be observed that the lower and upper cantilever structures 312, 332 and lower and upper tubes 304, 308 are removable from the guide post 296. This construction allows the dolly 70 to be readily disassembled for more convenient transport and storage.

The lifting mechanism 294 of each trailing dolly 70 comprises at least one and desirably two cylinder mechanisms, each of which is also designated 294. In the illustrated embodiment, the cylinder mechanisms 294 are mounted on the platform 252 on opposite sides of the guide post 296 as the dolly is viewed in FIG. 7. The cylinder mechanisms 294 have extensible and retractable plungers 370 which engage the lower cantilever structure 312 of the lift frame 300, and specifically with a cross beam 374 attached to the two lower arms 316 of the lower cantilever structure 312. When the plungers 370 of the cylinder mechanisms are in engagement with the cross beam 374, operation of the mechanisms (via levers 380) to extend the plungers 370 will lift the lower arms 316 and the upper arms 334 a desired distance. (The upper arms 334 move simultaneously with the lower arms 316 due to the spacer members 360 on the upper arms contacting the lower arms.) In the illustrated embodiment, each cylinder mechanism 294 is a hydraulic bottle jack having a stroke of seven in. and capable of lifting a six-ton load, but other types of jacks or lifting mechanisms having different load capacities and stroke lengths can be used.

Referring to FIG. 3, it will be observed that the central vertical axis 384 of the guide post 296 is on the leading side of the axis of rotation of the wheels, the leading offset being by a distance D3. The central vertical axes 388 of the jack plungers 370 are on the same leading side of the axis of rotation of the wheels, the leading offset being by a distance generally corresponding to the same distance D3. Other configurations may be used.

Figure 9:
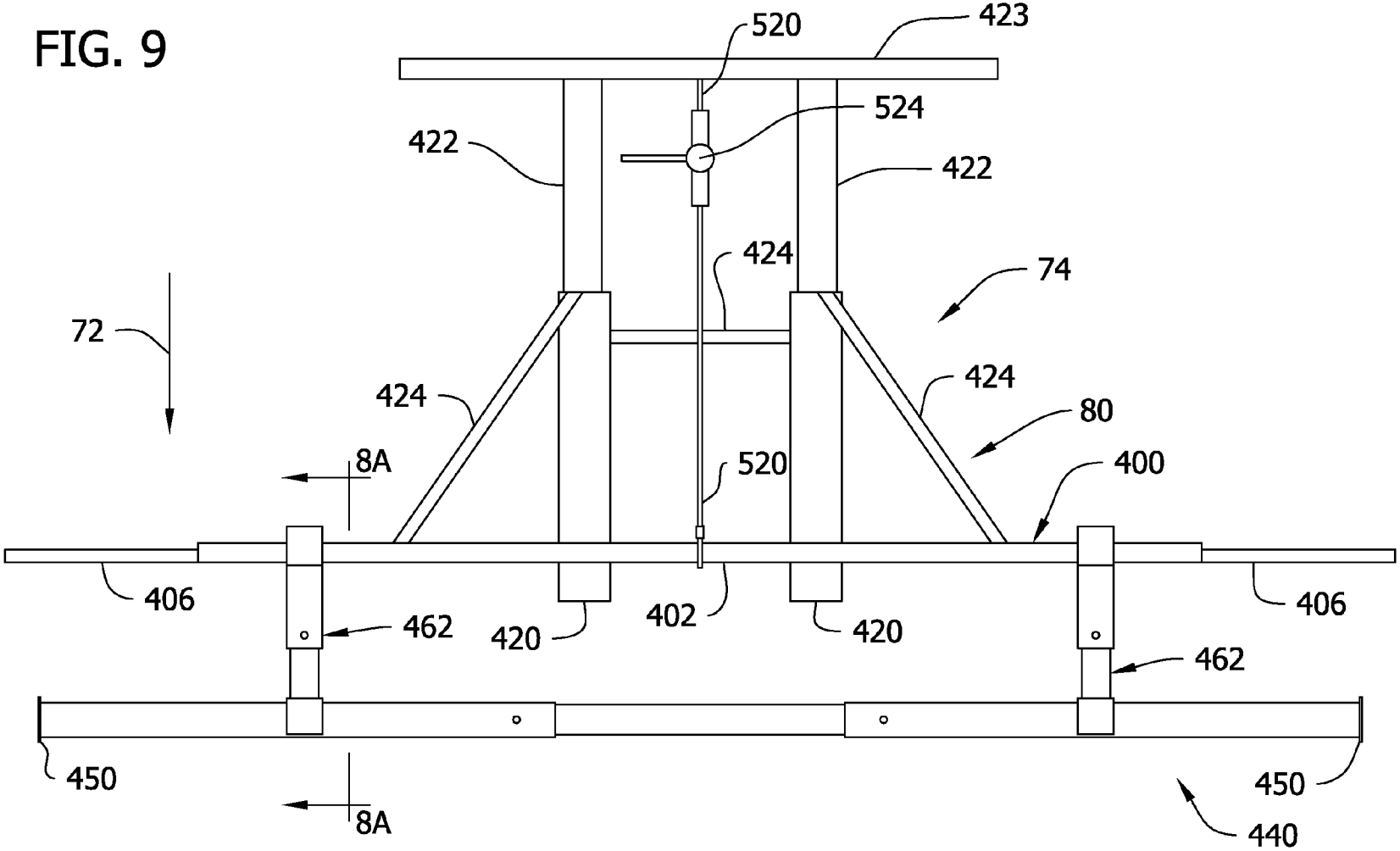
FIG. 9 is a plan view of a pusher bar assembly, spreader bar, and spacers of the transport system.
Figure 15:
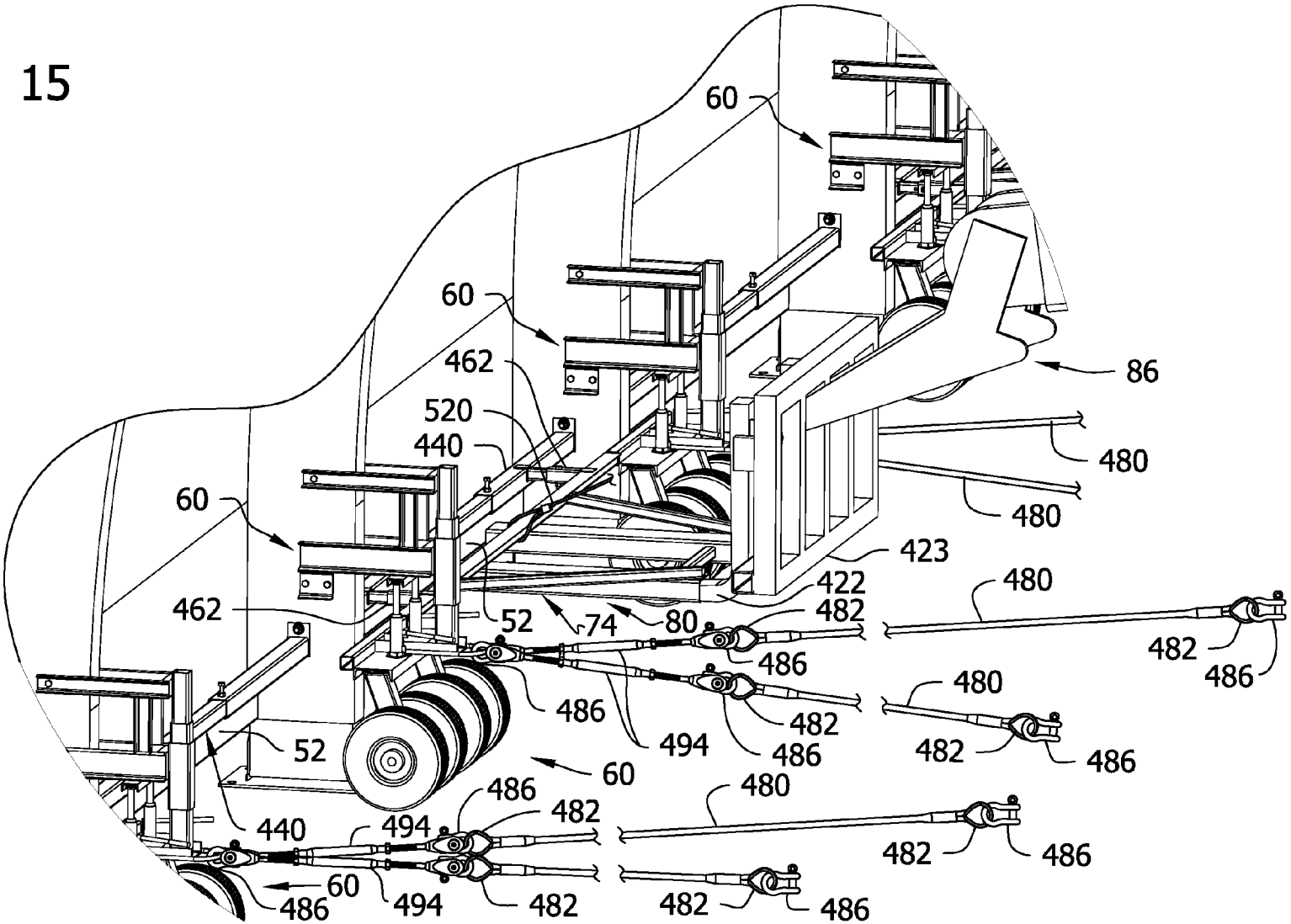
FIG. 15 is a perspective view of a pair of leading dollies connected by a pusher bar assembly coupled to a motorized vehicle for applying a motive force to roll the dollies in a forward direction.

Referring to FIGS. 9 and 15, each substantially rigid connector 74, for releasably connecting two adjacent leading dollies 60 comprises a pusher bar assembly 80. As shown in FIG. 9, each such assembly 80 includes a horizontal pusher bar 400 having an elongate center section 402 and elongate end sections 406 rigidly attached to respective ends of the center section 402. The end sections 406 have outer (free) ends which fit inside tubular socket members 410 affixed to the platform beams 130 of two adjacent leading dollies 60 (FIG. 3). The pusher bar assembly 80 further comprises a pair of spaced apart horizontal beams 420 affixed, as by welding, to the center section 402 of the pusher bar 400. The beams 420 extend in a trailing direction from the pusher bar 400 and are configured for releasable coupling to a motorized vehicle 86 that can be operated to apply a pushing force to the pusher bar assembly 80 and to the two leading dollies 60 connected by the assembly. In the illustrated embodiment, the beams 420 of the pusher bar assembly 80 are hollow beams having open trailing ends for receiving the forks (tines) 422 on a fork frame 423 of a forklift, for example. Other coupling arrangements are possible. Braces 424 extend between the beams 420 and between the beams 420 and the pusher bar 400 for reinforcement.

Figure 10:
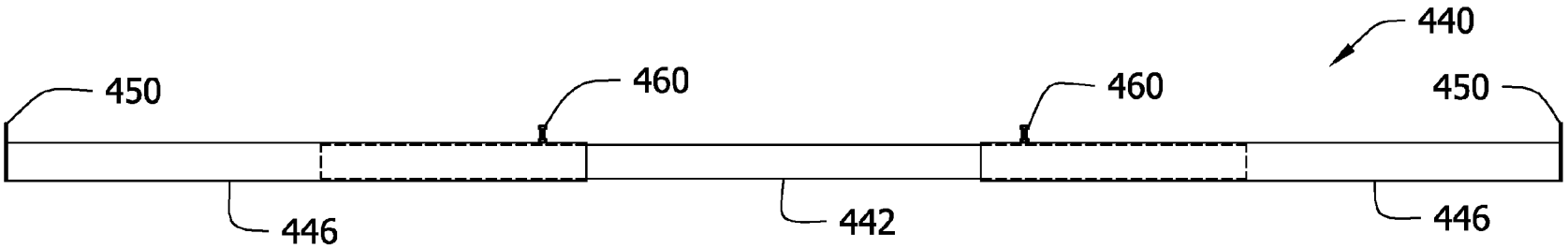
FIG. 10 is a top plan of the spreader bar of FIG. 9.
Figure 11:
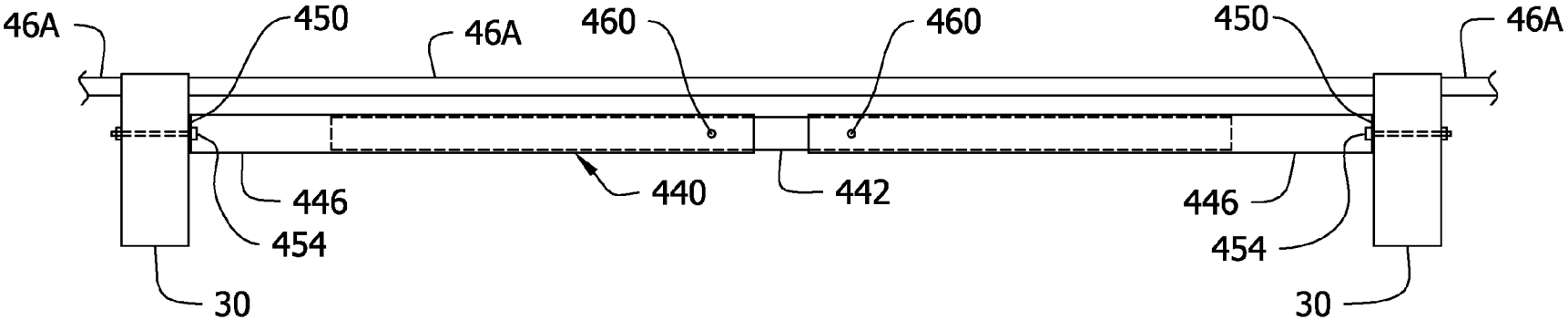
FIG. 11 is a top plan of the spreader bar in place to reinforce the building to be moved.
Figure 12:
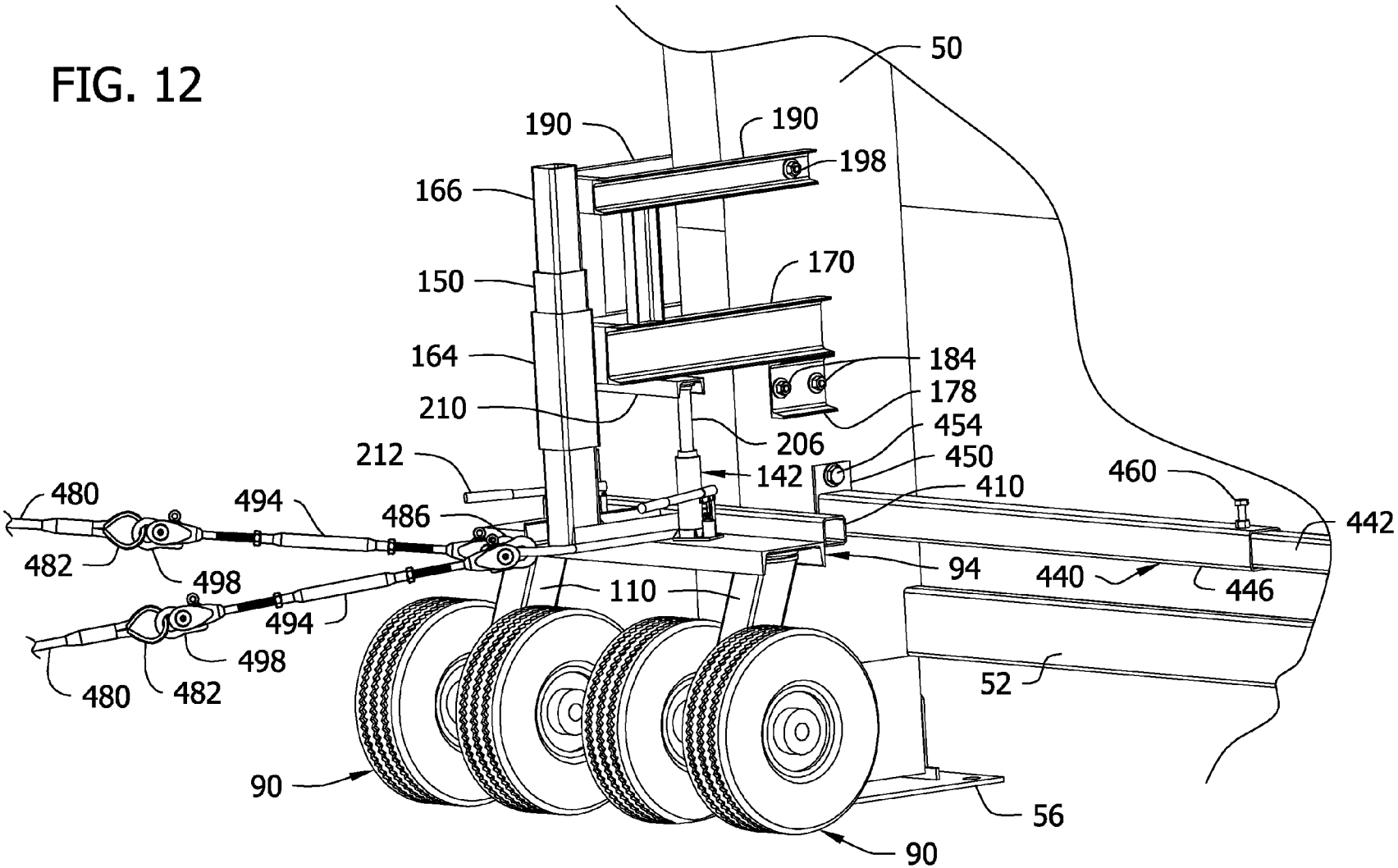
FIG. 12 is a perspective view showing the connection between a leading dolly and the building frame, and a tie member for connecting the leading dolly to a trailing dolly.

The transport system also includes a plurality of spreader bars, each generally designated 440, for reinforcing the frame 38 of the building 30 at locations adjacent the connections between the arches 50 and the lifting devices 96, 256 on the dollies 60, 70. One such spreader bar 440 is shown in FIGS. 9-11. The spreader bar 440 comprises a center section 442 and two end sections 446 having a sliding telescoping fit with respect to the center section, the arrangement being such that the overall length of the spreader bar can be varied to correspond to the distance between two adjacent arches of the building. The end sections 446 have mounting plates 450 affixed to their outer (free) ends. As shown in FIGS. 11 and 12, the spreader bar 440 is adapted to be placed in a generally horizontal position between two adjacent arches 50, with the mounting plates 450 in contact with the sides of respective arches. Suitable fasteners 454 (e.g., bolts) are used to releasably secure the mounting plates to the arches. After the fasteners 454 are installed, the end sections 441 of the spreader bar are locked in place relative to the center section 442 by locking devices such as set screws 460. The spreader bars 440 serve to strengthen the frame 38 during transport of the building 30.

Figure 13:
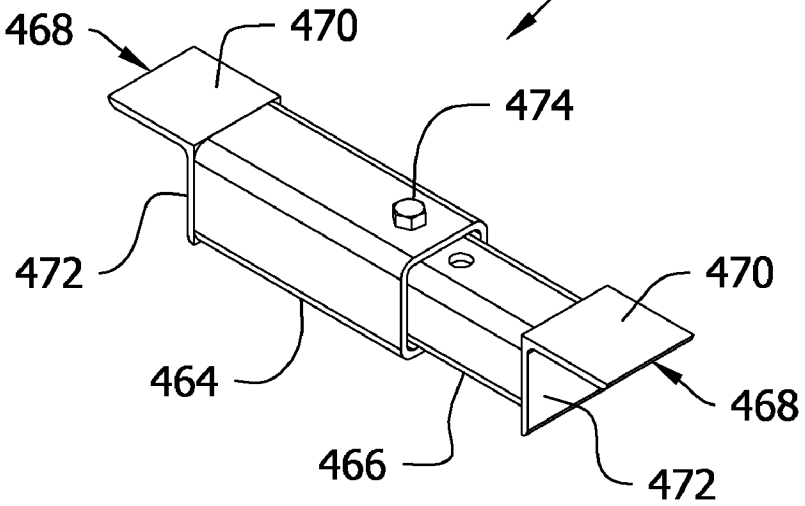
FIG. 13 is a perspective of a spacer of FIG. 9.
Figure 14:
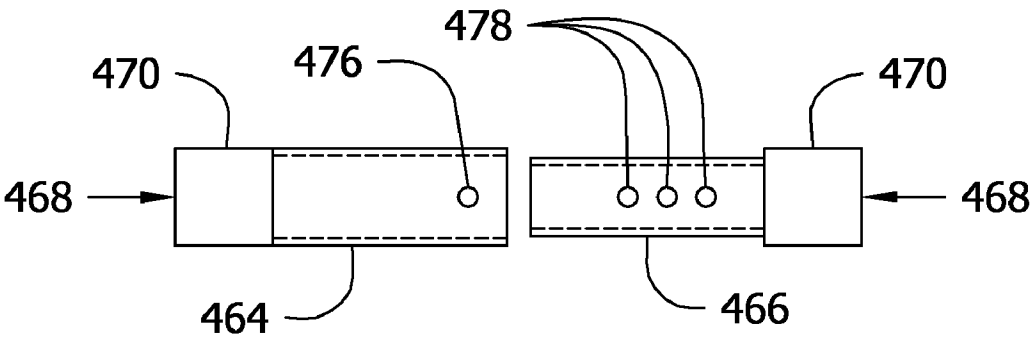
FIG. 14 is an exploded side view of the spacer showing component parts.

As shown in FIGS. 9, 13 and 14, spacers 462 are used between each pusher bar 400 and an adjacent spreader bar 440 to prevent excessive deflection of the pusher bar when a pushing force is applied to the pusher bar assembly 80. Each spacer 462 comprises an outer tubular spacer member 464, an inner spacer member 466 having a sliding fit in the outer spacer member, and a pair of angle members 468 affixed to the outer ends of the spacer members. The angle members 468 have horizontal legs 470 projecting endwise from the spacer members 464, 466 adapted to rest on the upper surfaces of the pusher bar 400 and spreader bar 440 and vertical legs 472 affixed to respective ends of the angle members. In use, the spacer members 464, 466 are telescoped relative to one another to adjust the length of the spacer to correspond to the desired spacing between the pusher bar 400 and the spreader bar 440. The spacer members are then locked in position by means of a nut-and-bolt fastener 474 passing through a hole 476 in the outer spacer member 464 and one of several holes 478 spaced at intervals along the length of the inner spacer member 466. At least two, and preferably three spacers 462 are then positioned between the pusher bar 400 and the spreader bar 440, as illustrated in FIG. 9.

Figure 16:
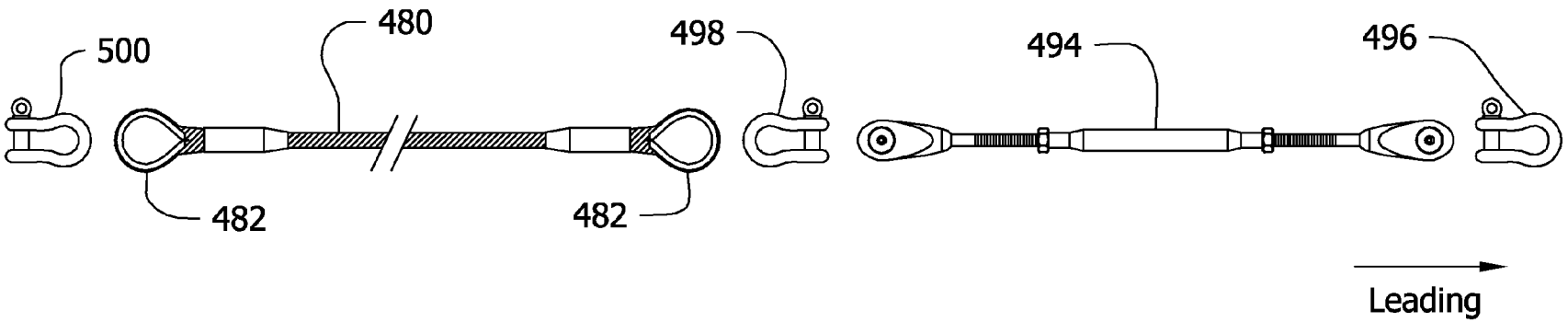
FIG. 16 is a view illustrating various components for connecting a tie member to a leading dolly and a trailing dolly.

Referring to FIGS. 2, 15 and 16, the transport system 20 also includes one or more tie members 480 releasably connecting the leading dollies 60 to the trailing dollies 70 to prevent substantial separation of the trailing dollies from the leading dollies during movement of the building 30. These tie members 480 reduce the stress and strain that the frame 38 might otherwise be subjected to without the tie members. In the illustrated embodiment, each tie member 480 comprises a length of flexible metal cable having loops 482 at opposite ends. The loops 482 are connected, either directly or indirectly, to a first tow member 488 affixed to the platform 94 of a leading dolly 60 and to a second tow member 490 affixed to the platform 252 of a trailing dolly 70. Desirably, at least one turnbuckle 494 is provided for adjusting the length of each tie member 480. In the illustrated embodiment (FIGS. 12, 15 and 16), a single turnbuckle 494 is positioned between the leading end of the tie member 480 and the tow member 488 of the leading dolly 60. The leading end of the turnbuckle 494 is connected to the tow member 488 by means of a shackle 496, and the trailing end of the turnbuckle is connected to the loop 482 at the leading end of the tie member 480 by means of another shackle 498. The trailing end of the tie member 480 is connected to the tow member 490 of the trailing dolly by a shackle 500. Other connecting configurations and connecting devices may be used. Further, the length of each tie member 480 can be increased by adding one or more tie extensions (not shown) to the tie member. Each tie extension may comprise a length of cable having a loop at one end for connection via a shackle to the tie member 480 and a loop at its other end for connection to another component of the system.

Referring to FIG. 2, the leading and trailing dollies 60, 70 are connected in a criss-cross ("X") pattern by the tie members 480. That is, a leading dolly 60 connected to one arch 50 is tied to a trailing dolly 70 connected to a different arch, and preferably an adjacent arch. This pattern is desirable to maintain the alignment of the arches 50 and the overall rigidity of the frame 38 as it is moved forward.

The process for moving a building 30 using the transport system 20 will now be described. The spreader bars 440 are placed in position between adjacent arches 50 and fastened to the arches at locations adjacent (e.g., below) the connections to be made between the lower arms of the dollies 60, 70 and the arches. With the spreader bars in place, the pusher bar assemblies 80 and leading dollies 60 are moved into respective positions adjacent the arches at the leading side 32 of the building 30, as described below. The inside anchor pins anchoring the foot plates 56 to the ground are removed before the dollies are 60, 70 are moved into position.

Each pusher-bar assembly 80 is positioned by inserting the forks 422 of a suitable forklift into the beams 420 of the assembly and moving the assembly into a position generally adjacent a respective spreader bar at the leading side 32 of the building. Two leading dollies 60 are then rolled (e.g., by hand) to positions in which the end sections 406 of the pusher bar 400 are received in respective tubular socket members 410 of the two dollies, as shown in FIGS. 2 and 9. The forklift is then operated to push the pusher bar assembly 80 and to roll the two dollies 60 connected by the assembly into a position in which the lower and upper arms 170, 190 of the two dollies are alongside respective arches 50. Suitable fastener holes are drilled in the arches to receive the fasteners 180, 196 which will secure the leading dollies 60 to the arches. If desired, these holes can be drilled before moving the dollies into position. Each dolly 60 is connected by fastening the lower arms 170 of the lift frame 160 to the arch 50 using fasteners 184 (FIG. 12). The upper arms 190 are similarly fastened to the arch 50 using fasteners 198. The spacers 462 are installed between the pusher bars 400 and spreader bars 440 to reduce flexing of the tubular members when the temporary building is moved to its new location. A suitable support (not shown) may be placed on the ground below a brace 424 of the pusher bar assembly 80 to support pusher bar assembly temporarily in position while the forklift is used to position another pusher bar assembly 80 and pair of leading dollies.

The trailing dollies 70 are connected to respective arches 50 at the trailing side 34 of the building by rolling the dollies into positions in which their lower and upper arms 316, 334 are adjacent the arches. Suitable fastener holes are drilled in the arches to receive the fasteners 326, 342 which will secure the trailing dollies 70 to the arches. If desired, these holes can be drilled before moving the dollies into position. Each dolly 70 is connected to a respective arch 50 by fastening the lower arms 316 to the arch 50 using fasteners 326 (FIG. 3). The upper arms 334 are similarly fastened to the arch 50 using fasteners 342.

With the leading and trailing dollies 60, 70 in position and fastened to respective arches 50 at the leading and trailing sides 32, 34 of the building 30, the one or more forklifts to be used in moving the building are moved into a position in which their respective forks 422 are received in the beams 420 of respective pusher bar assemblies 80. A suitable connecting member (e.g., a cable 520 tightened by a ratchet mechanism 524; FIGS. 9 and 15) is used to connect the pusher bar 400 and the fork frame 423 of the forklift to prevent separation of the forks 422 from the beams 420 so that the forklift has total control of the movement of the building, allowing the forklift to serve as a braking system.

To ensure smooth travel during structure movement, the ground surface over which the dollies are to roll may be leveled. (Typically, this step will be the first step in preparing for the move.) Plywood runways may be placed on the ground along the travel path of the leading and trailing dollies. For non-linear travel, the rate of travel should be reduced so that spotters used during the relocation process can better ensure that plywood placement is along the projected travel path. A leap-frog placement approach may generally be utilized prior to reaching end-point.

The leading and trailing dollies 60, 70 are connected using the time members 480 and accompanying shackles 496, 498, 500, turnbuckles 494 and tow members 488, 490.

With the components of the transport system 20 in place as described above, the outside anchor pins anchoring the foot plates 56 to the ground are removed, and the lifting mechanisms 142, 294 of the leading and trailing dollies 60, 70 are operated to lift the leading and trailing sides 32, 34 of the building an appropriate distance (e.g., four to six inches) above the ground, or the runways if they are used, for transport of the building to a new location. The lifting process should not be carried out in bad weather conditions, such as when wind speeds are excessive (e.g., over eight mph).

The specific order of the steps described above can be varied.

The forklifts are then operated in unison to push the pusher assemblies 80 for applying the motive force necessary to roll the leading and trailing dollies 60, 70 in the desired direction and thus move the building. The application of a sufficient amount of force will cause the leading dollies 60 to roll in a direction generally perpendicular to a line defined by the leading dollies or at a suitable angle off perpendicular. The caster wheels 100, 260 of the dollies automatically swivel to allow rolling movement in the desired direction. For safety reasons, and to avoid undue stress and strain on the building, the speed of transport is typically a relatively slow creeping movement (e.g., four mph or less).

When the building 30 is moved to its new location, the cylinder mechanisms 142, 294 of the dollies 60, 70 are operated to lower the building to the ground, and the crew makes any necessary adjustments to the building frame 38 before installing the outer anchor pins to anchor the foot plates 56 to the ground to stabilize the structure. After the building has been squared and secured to the ground, the tie members 480 are removed from the dollies; the tension members 520 connecting the pusher bars 400 and fork frames are disconnected; the forklifts are disconnected from the pusher bar assemblies 80 by removing the forks 422 from the beams 420; the pusher bar assemblies are disconnected from the leading dollies 60; the spreader bars 440 are removed; and the upper and lower arms of the dollies are unfastened from their respective arches 50. The inner anchor pins are then installed. The specific order of these steps can be varied.

If desired, the temporary building 30 can be partially disassembled to divide it into separate erect sections 30A, 30B, (FIG. 1) prior to relocation of the building. This is particularly desirable in situations where the building is long (e.g., 45 meters). By way of example but not limitation, the temporary building 30 in FIGS. 1 and 2 having a length of seven bays 54, may be moved by removing a center bay 54 and then moving the remaining three-bay sections 30A, 30B created by removal of the center bay. Each multiple-bay section is moved in an erect condition and independent of the other section(s) to the new site, after which the multiple-bay sections are reconnected (e.g., by adding the center bay removed earlier) for subsequent use of the building. In the case of a building having the construction of building 30 shown in FIG. 1, the process of separating the building into two sections generally involves removing a cover section 46A extending between two arches 50 over one of the bays, and then unfastening and removing the purlins 52 and another frame components connecting those same two arches. The remaining two building sections can then be moved separately.

The above transport system 20 can be used for moving most types of large temporary tension-fabric structure buildings, and particularly a large rectangular-shaped temporary building sized to cover a planar ground area of at least 500 square meters. In one example, the temporary building 30 has an overall length of about 35 meters, an overall width of about 36 meters, and an overall height of about 14 meters, and the building has seven bays 54 defined by arches 50 spaced at center-to-center intervals of about five meters. These dimensions may vary, e.g., lengths of 15-75+ meters, widths of 10.5-15 meters, and heights of 10-20 meters.

The above transport system 20 has particular (albeit not exclusive) application for transporting large tent-like structures used for the remediation of waste sites. In general, the process for remediating such a waste site in accordance with this invention comprises the following steps: (i) installing the temporary building at a first location on the site; (ii) remediating the site inside the temporary building at the first location (using conventional techniques) and backfilling the excavation; (iii) preparing the site and building 30 for relocation; (iv) lifting the temporary building while it is erect; (v) moving the temporary building while it remains erect to a second location on the site; (vi) lowering the temporary building while it remains erect to place it on the site, and (vii) remediating the site inside the temporary building at the second location. In accordance with this invention, the lifting, moving and lowering of the temporary building (steps (iv), (v) and (vi) above) involves connecting a plurality of leading dollies (e.g., dollies 60) to a first side of the building and a plurality of trailing dollies (e.g., trailing dollies 70) to a second side of the building, operating the dollies to lift respective first and second sides of the building, applying a motive force to the leading dollies to roll the dollies and the temporary building from the first location to the second location, and operating the dollies to lower respective first and second sides of the building. The leading and trailing dollies used in this process can be of the type described above (i.e., leading dollies 60 and trailing dollies 70).

In certain embodiments described above, the leading dollies 60 are pushed by one or more motor vehicles (e.g., forklift trucks) located inside the building to provide the motive force necessary to move the building 30 from one location to another. One advantage of pushing from inside the building is that the building can be moved to a location immediately adjacent to (e.g., abutting) a wall, structure or other boundary. However, it is contemplated that the building can be moved by applying a pulling (rather than pushing) force using one or more motor vehicles located outside the building. For example, cables could be attached to the leading dolly 60 and the trailing dolly at one side 36 of the building, and these cables could be pulled by one or more motor vehicles outside the building in a direction generally perpendicular to the arches 50. Regardless of the direction of movement, the caster wheels 100, 260 will rotate to align with the direction of movement.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A method of remediating a contaminated waste site, comprising installing a temporary building at a first location on the site, the temporary building comprising a frame and a cover, remediating the site inside the temporary building at the first location, lifting the temporary building while the temporary building remains erect, moving the temporary building while the temporary building remains erect to a second location on the site, lowering the temporary building while the temporary building remains erect to place the temporary building on the site, and remediating the site inside the temporary building at the second location, wherein said lifting, moving and lowering of the temporary building comprises connecting leading dollies to a first side of the temporary building and trailing dollies to a second side of the temporary building, connecting the trailing dollies to the leading dollies by tie members comprising flexible cable to prevent substantial separation of the trailing dollies from the leading dollies as the building is moved, operating the leading and trailing dollies to lift respective first and second sides of the temporary building, applying a motive force to the leading dollies to roll the leading and trailing dollies and the temporary building from the first location to the second location, and operating the leading and trailing dollies to lower respective first and second sides of the temporary building.

2. The method as set forth in claim 1 wherein said lifting, moving and lowering of the temporary building is carried out while some but not all of the leading and trailing dollies are inside the building.

3. The method as set forth in claim 2 wherein said leading dollies are pushed by one or more motor vehicles inside the building to move the building.

4. The method as set forth in claim 1 further comprising partially disassembling the temporary building to divide it into separate erect sections, and moving one erect section of the building independent of another erect section of the building.

* * * * *